US005501239A

United States Patent [19]

Walker

[11] Patent Number: 5,501,239

[45] Date of Patent: Mar. 26, 1996

[54] HAIR PIECE USING DECORATIVE CLIP

[75] Inventor: Lindsey J. Walker, London, Great Britain

[73] Assignee: Revlon Consumer Products Corporation, New York, N.Y.

[21] Appl. No.: 172,992

[22] Filed: Dec. 27, 1993

[30] Foreign Application Priority Data

Oct. 7, 1993 [GB] United Kingdom ..... 9320638

[51] Int. Cl.[6] ..... A45D 8/12; A41G 3/00

[52] U.S. Cl. ..... 132/275; 132/201; 132/53

[58] Field of Search ..... 132/201, 53, 54, 132/55, 275, 277

[56] References Cited

U.S. PATENT DOCUMENTS

| | | | |
|---|---|---|---|
| 1,713,616 | 5/1929 | Oppenheim | 132/53 |
| 2,165,716 | 7/1939 | Molleson | 132/53 |
| 2,651,310 | 9/1953 | Selson | 132/53 |
| 3,141,218 | 7/1964 | Eckman | 132/277 |
| 4,830,029 | 5/1989 | Bird | 132/53 |
| 5,303,724 | 4/1994 | Anzivino | 132/275 |

FOREIGN PATENT DOCUMENTS

| | | | |
|---|---|---|---|
| 946033 | 5/1949 | France | 132/277 |
| 2748601 | 5/1979 | Germany | 132/277 |

*Primary Examiner*—Todd E. Manahan
*Attorney, Agent, or Firm*—Julie Blackburn

[57] ABSTRACT

A hair piece comprising a switch of hair attached at one end to a clip. The clip comprises a pair of jaws having a mutual pivotal connection. The jaws of the clip are provided which a spring which urges the jaws into engagement.

14 Claims, 2 Drawing Sheets

HAIR PIECE USING DECORATIVE CLIP

BACKGROUND OF THE INVENTION

This invention related to hair pieces for attachment to the hair of the head of a user for the purpose of supplementing the natural hair of the user either to enable a wider variety of hair styles to be imparted to the user's hair or, where the user is endowed with relatively sparse hair, to simulate the impression of a fuller head of hair. Known forms of hair pieces provided for these purposes terminate at an end thereof in a loop of elasticated or other suitable material relatively to which the hair is fixed and which is employed to attach the hair piece to the natural hair of the user. This is accomplished by the user folding back this end of her (or his) natural hair then piling it up on the top of the head in which position it is secured by hair grips usually of hairpin form which are relatively unobtrusive. The loop of the hair piece is then buried in the piled up natural hair and the hair piece is then secured as by hairpins or other suitable grips by the loop and/or the hair adjoining the loop, to the natural hair. The hair piece can then be arranged to suit the purposes of the user.

This procedure is tedious and requires a significant measure of skill for its implementation. It is an object of the present invention to provide a hair piece which may be natural or synthetic hair, which can be attached to the natural hair of the user in an improved and simpler manner than the hitherto been the case.

SUMMARY OF THE INVENTION

The present invention consists in a hair piece comprising a switch of hair attached at an end thereof to a clip comprising a pair of jaws mutually pivotally connected and provided with spring means which urge said jaws into engagement.

DETAILED DESCRIPTION

Suitably, the jaws are provided with gripping means at edges thereof which are biased into engagement by the spring means.

Advantageously, the switch of hair is attached to the clip jaws adjacent to the mutual pivotal connection thereof. Preferably, the attachment of the hair switch is to the inner surfaces of the jaws.

In one form of the invention the spring jaw clip is attached to the hair switch in readily separable fashion. This can be accomplished by provided on one or both of the clip jaws a mounting to which a loop at an end of the switch is separably attached. By having the switch readily separable from the clip, the switch can be optionally attached to a large decorative clip to provide a stylish feature of the switch when in use or alternatively can be attached to a small clip which can be unobtrusively mounted in the natural hair of the user.

Figure 1:
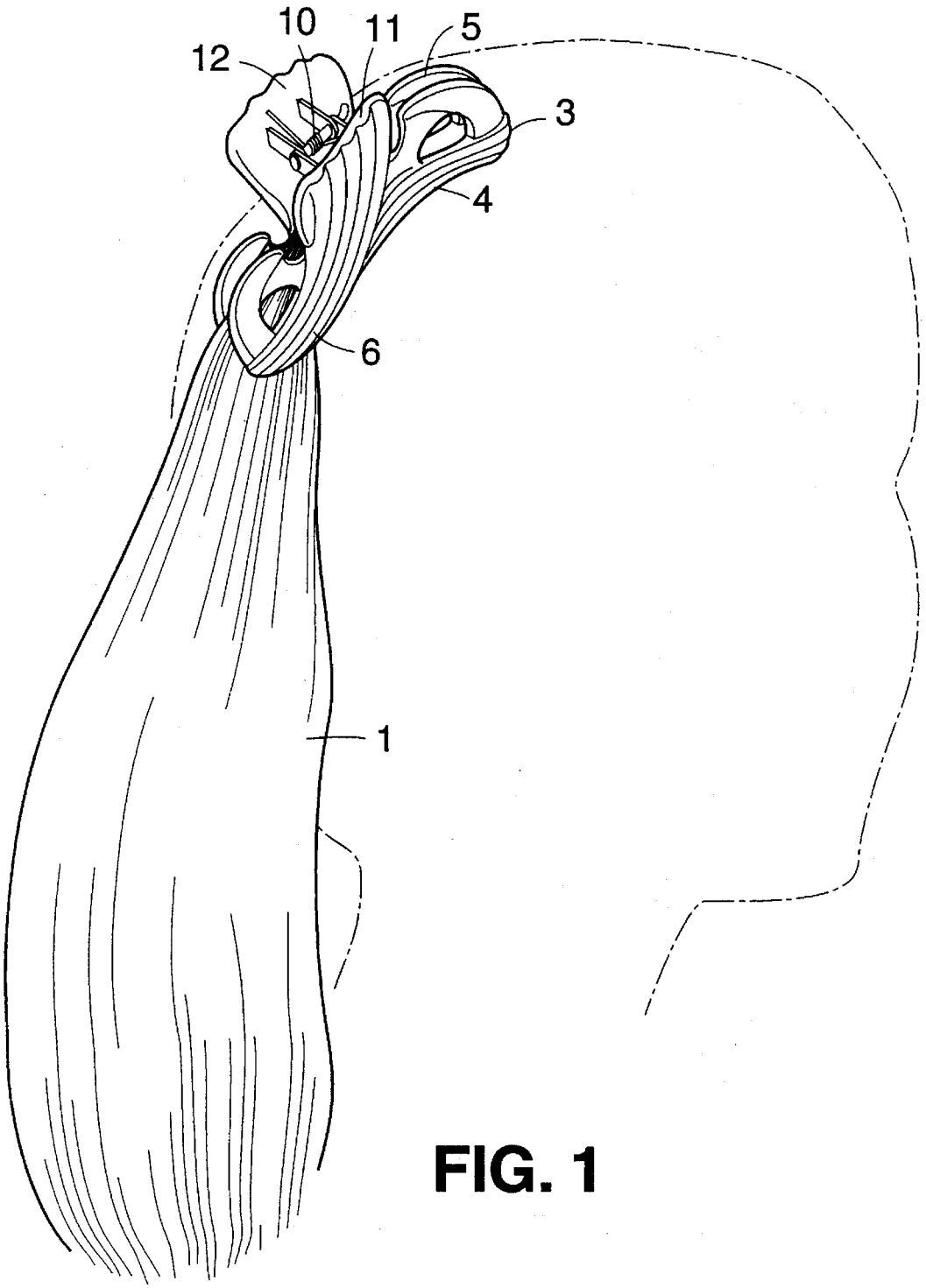
Figure 2:
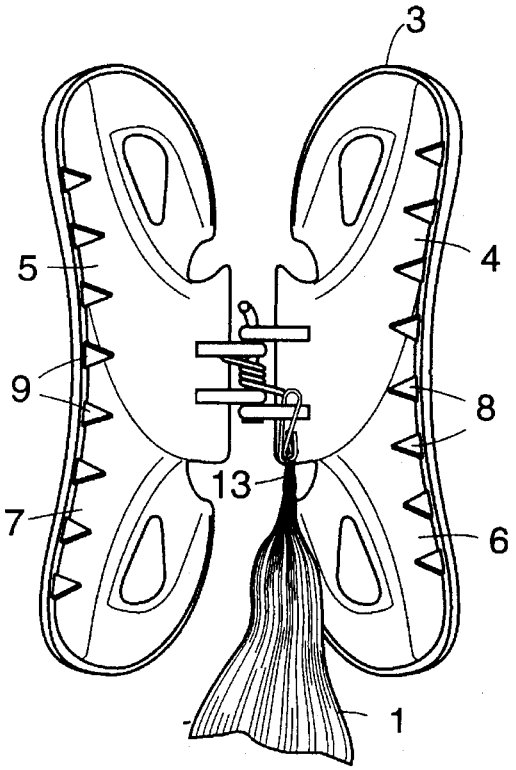

The invention will now be described, by way of example, with reference to the accompanying diagrammatic drawings, in which:

FIG. 1 is a perspective view of a hair piece in accordance with the invention; and FIG. 2 is a view of the hair piece from below.

Figure 3B:
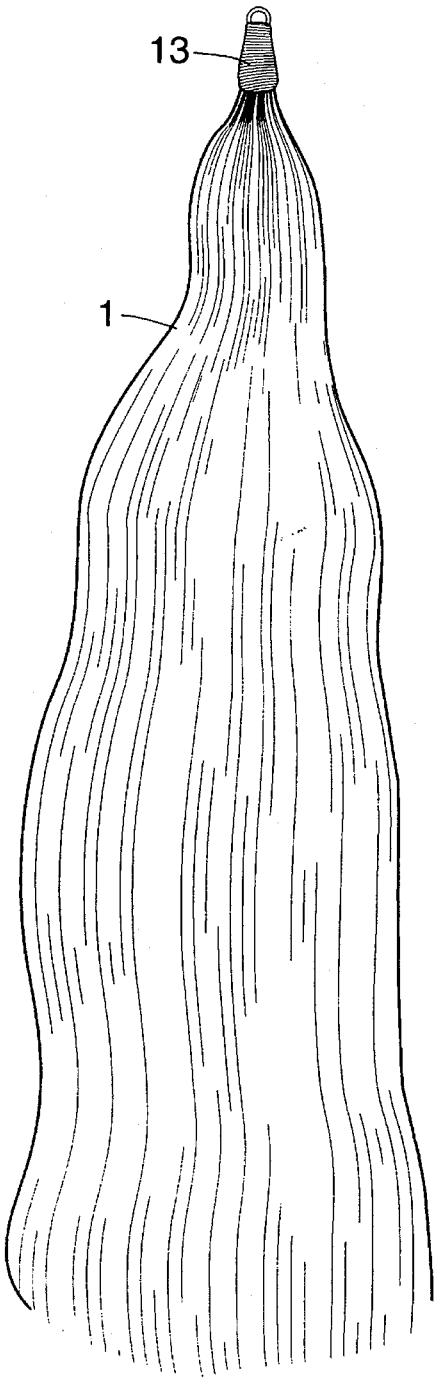
Figure 3A:
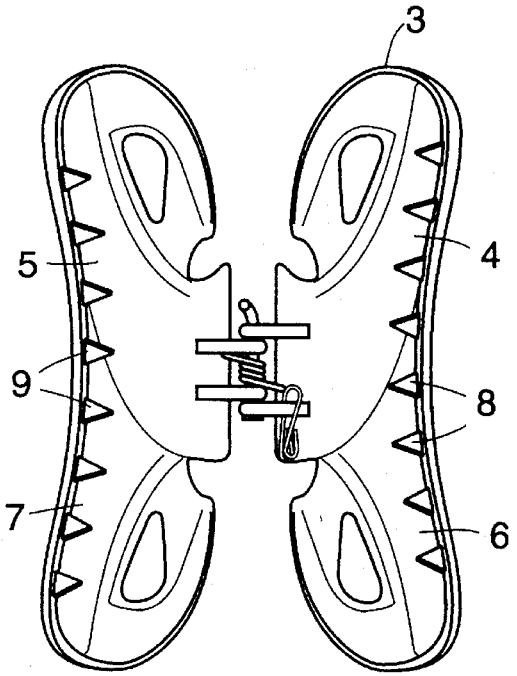

FIG. 3*a* is a view of the clip containing a hook which is used to secure the hair switch.

FIG. 3*b* is a view of the hair switch which is bound by a loop of fabric or elastic which permits securing of the switch to the hook illustrated on the clip of FIG. 3*a*.

The hair piece comprises a group of hairs forming a switch 1, attached at adjacent ends to a hair clip 3 which is a decorative form of so-called "bulldog" clip or "butterfly" clip comprising jaws 4 and 5 which are hinged together and spring loaded by spring 10 so that arcuate forward edges 6 and 7 are provided with gripping teeth 8 and 9. The jaws of the clip are opened against the spring biassing force by pressing together ears 11 and 12 of the clip disposed on the side of the spring 10 remote from the forward arcuate edges 6 and 7 of the clip.

The adjacent ends of the hair strands of the hair switch are wrapped in a strip of material 13 to hold them together and are glued to the inner faces of the jaws of the clip. The ends of the hair could be attached in any other suitable manner for the clip, either permanently or in a readily detachable manner. For example, these ends may be secured to a loop of elasticated or other suitable material which itself is then attached to mountings, such as hooks, on inner faces of the clip jaws. The hair could be attached to one end of a loop of fabric, the other end being attached to the clip.

The clip illustrated is a decorative clip which is intended to form a feature of the wearer's hair when worn. Alternatively, a much smaller form of bulldog clip can be employed which when mounted in the hair of the wearer can be unobtrusive and possibly totally hidden.

The hairs forming the switch could be provided in any suitable form, for example as straight hair or curls, layers or in the form of a braid.

In use of the hair piece described, the user folds back his or her natural hair at the back of the head effectively to pile up the natural hair towards or on top of the user's head. This is done with one hand whilet the other hand opens the jaws of the bulldog clip by pressing the ears of the jaws together and the forward edges of the jaws are then placed against the natural hair of the user so that the teeth of the jaws engage the natural hair both in the folded back parts thereof and in the parts of the hair adjacent the hair roots. In this way, the hair switch is firmly secured to the hair of the user's head. The hair of the switch is then disposed by the user in desired manner. For example, when a decorative bulldog clip is employed, the hair may be disposed as a ponytail with the clip forming a decorative feature. In another form where a small clip is used with a switch of relatively straight hair, the clip when mounted in the natural hair in the manner described above, can be hidden from view or largely so and the hair of the switch can then be disposed either to give an impression of a fuller head of hair or to provide a novel hair style for the user.

The hair piece of the invention enables attachment of a switch of hair to the hair of the user in a much simpler manner than has been the case hitherto and mounting of the hair piece is very rapidly effected.

We claim:

1. A hair piece comprising a switch of hair attached at one end thereof to a clip; said clip comprising a pair of jaws having a mutual pivotal connection, each of said jaws having an edge portion spaced from said pivotal connection, said edge portions being curved in a concave sense in a direction away from said pivotal connection, said edge portion being formed with mutually engageable gripping means; said clip further comprising spring means which urges said edge portions of said jaws together and said gripping means into mutual engagement;

said clip further comprising a pair of ears disposed on the side of said spring means remote from said jaw, whereby, when said ears are pressed together, said jaws are opened against a force exerted by said spring means.

2. The hair piece of claim 1 wherein the switch of hair is attached to the jaws adjacent to the mutual pivotal connection thereof.

3. The hair piece of claim 2 wherein the switch of hair is attached to the inner surface of one or both jaws adjacent to the mutual pivotal connection thereof.

4. The hair piece of claim 3 wherein the switch of hair is secured at one end by a securing means to hold the individual hair strands together.

5. The hair piece of claim 4 wherein the switch of hair is permanently attached to the inner surface of said jaws.

6. The hair piece of claim 5 wherein the securing means in a strip of fabric.

7. The hair piece of claim 6 wherein the securing means is inseparably attached to the inner surface of said jaws with glue.

8. The hair piece of claim 5 wherein the clip is decorative clip.

9. The hair piece of claim 5 wherein the clip is a small clip disposed to be hidden in the natural hair.

10. The hair piece of claim 5 wherein the switch of hair comprises straight hair, curly hair, or a braid.

11. The hair piece of claim 4 wherein the switch of hair is secured at one end by a securing means which comprises a loop.

12. The hair piece of claim 11 wherein the switch of hair is secured at one end by a securing means which comprises a loop.

13. The hair piece of claim 12 wherein the inner surface of said jaws comprises a mounting capable of engaging the loop of the securing means.

14. The hair piece of claim 13 wherein the loop is elastic or fabric.

* * * * *

UNITED STATES PATENT AND TRADEMARK OFFICE

CERTIFICATE OF CORRECTION

PATENT NO. : 5,501,239

DATED : March 26, 1996

INVENTOR(S) : Lindsey Julia-Jane Walker

It is certified that error appears in the above-identified patent and that said Letters Patent is hereby corrected as shown below:

On the title page, after "[73] Assignee:" delete "Revlon Consumer Products Corporation"

Signed and Sealed this

Twenty-third Day of July, 1996

*Attest:*

*Attesting Officer*

BRUCE LEHMAN

*Commissioner of Patents and Trademarks*